US008620615B2

(12) United States Patent
Oexman et al.

(10) Patent No.: US 8,620,615 B2
(45) Date of Patent: Dec. 31, 2013

(54) APPARATUSES AND METHODS FOR EVALUATING A PERSON FOR A SLEEP SYSTEM

(75) Inventors: Robert D. Oexman, Carthage, MO (US); David B. Scott, Carthage, MO (US)

(73) Assignee: Kingsdown, Inc., Mebane, NC (US)

( * ) Notice: Subject to any disclaimer, the term of this patent is extended or adjusted under 35 U.S.C. 154(b) by 344 days.

(21) Appl. No.: 12/867,740

(22) PCT Filed: Nov. 14, 2008

(86) PCT No.: PCT/US2008/083633

§ 371 (c)(1),
(2), (4) Date: Aug. 13, 2010

(87) PCT Pub. No.: WO2009/102362

PCT Pub. Date: Aug. 20, 2009

(65) Prior Publication Data

US 2010/0317930 A1 Dec. 16, 2010

Related U.S. Application Data

(60) Provisional application No. 61/028,578, filed on Feb. 14, 2008.

(51) Int. Cl.
*G01L 17/00* (2006.01)

(52) U.S. Cl.
USPC ..... 702/139

(58) Field of Classification Search
USPC ..... 702/47, 50, 81, 129, 138, 139, 173, 702/175, 183; 5/713; 73/127
See application file for complete search history.

(56) References Cited

U.S. PATENT DOCUMENTS 3,462,778 A 8/1969 Whitney
3,786,676 A 1/1974 Korolyshun et al.

(Continued)

FOREIGN PATENT DOCUMENTS

GB 2373189 A 9/2002
JP 2000189472 A 7/2000

(Continued)

OTHER PUBLICATIONS

Diffrient, Niels et al., Humanscale 1/2/3, 1974, The MIT Press, Cambridge.

(Continued)

*Primary Examiner* — Mohamed Charioui
(74) *Attorney, Agent, or Firm* — Sughrue Mion, PLLC

(57) ABSTRACT

A method for evaluating a person for a sleep system, the method including: while the person is not positioned on an evaluating member, adjusting a pressure of a comfort layer inflatable member disposed within a comfort layer of the evaluating member to an initial comfort value; positioning the person on the evaluating member in a first position; while the person is positioned on the evaluating member in the first position, measuring a pressure of the comfort layer inflatable member as a first measured comfort value; calculating a difference between the first measured comfort value and the initial comfort value as comfort pressure 1; calculating a first optimal pressure level for the comfort layer inflatable member using comfort pressure 1; and recommending a sleep support member for the person using the calculated first optimal pressure level for the comfort layer inflatable member and using data measuring quality of sleep.

19 Claims, 9 Drawing Sheets

(56) References Cited

U.S. PATENT DOCUMENTS

| | | | | |
|---|---|---|---|---|
| 4,466,385 | A | 8/1984 | Waryasz | |
| 4,501,034 | A | 2/1985 | Greenawalt | |
| 4,656,334 | A | 4/1987 | Endo et al. | |
| 4,982,466 | A | 1/1991 | Higgins et al. | |
| 5,062,169 | A * | 11/1991 | Kennedy et al. | 5/713 |
| 5,105,488 | A | 4/1992 | Hutchinson et al. | |
| 5,148,706 | A | 9/1992 | Masuda et al. | |
| 5,231,717 | A | 8/1993 | Scott et al. | |
| 5,283,735 | A * | 2/1994 | Gross et al. | 600/587 |
| 5,446,933 | A | 9/1995 | Gabelhouse | |
| 5,636,396 | A | 6/1997 | Workman et al. | |
| 5,848,450 | A | 12/1998 | Oexman et al. | |
| 5,850,644 | A | 12/1998 | Hsia | |
| 5,948,303 | A | 9/1999 | Larson | |
| 5,987,675 | A | 11/1999 | Kim | |
| 5,989,258 | A | 11/1999 | Hattori | |
| 6,212,718 | B1 | 4/2001 | Stolpmann et al. | |
| 6,220,088 | B1 | 4/2001 | Scales et al. | |
| 6,226,792 | B1 | 5/2001 | Goiffon et al. | |
| 6,269,505 | B1 | 8/2001 | Wilkinson | |
| 6,327,725 | B1 | 12/2001 | Veilleux et al. | |
| 6,468,234 | B1 | 10/2002 | Van der Loos et al. | |
| 6,560,803 | B2 | 5/2003 | Zur | |
| 6,571,192 | B1 | 5/2003 | Hinshaw et al. | |
| 6,585,328 | B1 * | 7/2003 | Oexman et al. | 700/117 |
| 6,662,393 | B2 | 12/2003 | Boyd | |
| 6,687,935 | B2 | 2/2004 | Reeder et al. | |
| 6,741,950 | B2 | 5/2004 | Hinshaw et al. | |
| 6,878,121 | B2 | 4/2005 | Krausman et al. | |
| 6,916,236 | B2 | 7/2005 | Terpstra | |
| 6,986,182 | B2 | 1/2006 | Mossbeck | |
| 6,990,425 | B2 | 1/2006 | Hinshaw et al. | |
| 7,036,172 | B2 | 5/2006 | Torbet et al. | |
| 7,127,759 | B2 | 10/2006 | Koops | |
| 7,685,658 | B2 * | 3/2010 | Lokhorst et al. | 5/424 |
| 7,725,967 | B2 | 6/2010 | Simmerer et al. | |
| 7,764,180 | B2 | 7/2010 | Huang | |
| RE41,809 | E | 10/2010 | Hinshaw et al. | |
| 7,877,827 | B2 | 2/2011 | Marquette et al. | |
| 2003/0125899 | A1 | 7/2003 | Hinshaw et al. | |
| 2004/0139549 | A1 | 7/2004 | Mohrekesh et al. | |
| 2004/0177449 | A1 | 9/2004 | Wong et al. | |
| 2004/0215416 | A1 * | 10/2004 | Hinshaw et al. | 702/129 |
| 2005/0143617 | A1 | 6/2005 | Auphan | |
| 2005/0166326 | A1 | 8/2005 | Chaffee | |
| 2006/0112489 | A1 | 6/2006 | Bobey et al. | |
| 2006/0143831 | A1 | 7/2006 | Wu | |
| 2006/0179573 | A1 | 8/2006 | Nissen et al. | |
| 2006/0236460 | A1 | 10/2006 | Hooper | |
| 2007/0021965 | A1 | 1/2007 | Boyd | |
| 2007/0056112 | A1 | 3/2007 | Graebe | |
| 2007/0061974 | A1 | 3/2007 | Gabbay | |
| 2007/0061976 | A1 | 3/2007 | Bazargani | |
| 2007/0086947 | A1 | 4/2007 | Boyd | |
| 2007/0199154 | A1 | 8/2007 | Escaross | |
| 2007/0238935 | A1 | 10/2007 | Boyd | |
| 2008/0244831 | A1 | 10/2008 | Kenmochi | |
| 2009/0006027 | A1 | 1/2009 | Hinshaw | |
| 2009/0240514 | A1 | 9/2009 | Oexman et al. | |
| 2010/0313359 | A1 | 12/2010 | Scott et al. | |
| 2010/0318239 | A1 | 12/2010 | Oexman et al. | |
| 2011/0010014 | A1 | 1/2011 | Oexman et al. | |
| 2011/0010249 | A1 | 1/2011 | Oexman et al. | |
| 2011/0163885 | A1 | 7/2011 | Poulos et al. | |

FOREIGN PATENT DOCUMENTS

| | | | |
|---|---|---|---|
| JP | 2005-514515 | A | 5/2004 |
| WO | 9732509 | A1 | 9/1997 |
| WO | 9963314 | A1 | 12/1999 |
| WO | 0051470 | A1 | 9/2000 |
| WO | 2005104904 | A1 | 11/2005 |
| WO | 2006023479 | A2 | 3/2006 |
| WO | 2007053150 | A1 | 5/2007 |

OTHER PUBLICATIONS

Diffrient, Niels et al., Humanscale 4/5/6, 1981, The MIT Press, Cambridge.

Tilley, Alvin R., The Measure of Man and Woman, 2002, John Wiley & Sons, New York.

Jacobson, Bert H. et al., "Subjective Rating of Perceived Back Pain, Stiffness and Sleep Quality Following Introduction of Medium-Firm Bedding Systems," Journal of Chiropractic Medicine, Winter 2006, pp. 128-134, vol. 5, No. 4, National University of Health Sciences.

Iber, Conrad et al., The AASM Manual for the Scoring of Sleep and Associated Events: Rules, Terminology and Technical Specifications, 1st ed., 2007, American Academy of Sleep Medicine, Westchester, Illinois.

Dement, William C., "History of Sleep Physiology and Medicine," in Principles and Practice of Sleep Medicine, eds. Meir H. Kryger, Thomas Roth, and William C. Dement, 4th Edition, 2005 Elsevier Inc., Philadelphia.

Raymann et al., "Skin Deep: Enhanced Sleep Depth by Cutaneous Temperature Manipulation," Brain: A Journal of Neurology, 2008, pp. 500-513, vol. 131, Oxford University Press.

European Search Report dated Sep. 9, 2011 for EP08872440.6.

European Search Report dated Sep. 12, 2011 for EP08872303.6.

Russsian Office Action dated Jun. 8, 2011 for RU 2010135586.

Singapore Patent Office Action dated Feb. 27, 2012 for SG 201005897-2.

International Search Report dated Apr. 10, 2012 for PCT/US2011/050122.

Office Action ("Notification of Reasons for Refusal") dated Apr. 9, 2013, issued in Japanese patent application 2010-546748.

Office Action issued Oct. 1, 2013, in U.S. Appl. No. 13/712,351.

Office Action issued Oct. 1, 2013, in U.S. Appl. No. 13/712,213.

Office Action issued Nov. 7, 2013, in U.S. Appl. No. 12/919,189.

* cited by examiner

APPARATUSES AND METHODS FOR EVALUATING A PERSON FOR A SLEEP SYSTEM

CROSS-REFERENCE TO RELATED PATENT APPLICATION

This application claims priority from U.S. Provisional Patent Application No. 61/028,578, filed on Feb. 14, 2008, in the U.S. Patent and Trademark Office, the disclosure of which is incorporated herein by reference in its entirety.

BACKGROUND

1. Technical Field

Methods and apparatuses consistent with the present invention relate generally to the evaluation of a person that is positioned on a sleep system. More particularly, these methods and apparatuses relate to the measurement and analysis of characteristics of a particular person for a sleep system, to determining the sleep system characteristics that are most suitable for the person, and to providing a recommendation for a sleep system that is most suitable for the person.

2. Description of the Related Art

A wide variety of different sleep systems are currently available. Such sleep systems may comprise all aspects of a bedding assembly including, but not limited to, mattresses, box springs, foundation units, bed frames, pillows, mattress pads, linens and, more generally, to any type of sleep product that influences a person's sleep. However, each respective sleep system may be suitable for some persons but not suitable for others persons. The characteristics of a suitable sleep system for a person depend on a number of factors including, but not limited to, the physical attributes of the person (e.g., weight, height, body dimensions, weight distribution, etc.), preferred sleeping positions (e.g., sleeping on back, side, front, etc.), sleeping habits and so on.

Two very different primary components of sleep systems affect a person's overall sleep experience: support and comfort. First, a sleep system delivers support to a person by holding the person in a proper postural alignment, while evenly redistributing the person's body weight across a wide area so as to relieve interface pressure. For example, a mattress may deliver support through the resistance provided by innersprings to the downward force applied due to the person's body weight.

Second, a sleep system delivers comfort to a person's body through the use of comfort materials layered on a top region of the sleep surface. For instance, by layering finning pads and harder, high density foam on top of the innersprings, a mattress can be manufactured to provide varying levels of hardness or firmness. On the other hand, by layering soft materials over the innersprings like convoluted foam, low density foam and/or fiber materials like wool, silk or cashmere, a mattress can be manufactured to provide varying levels of softness or a more plush feel.

Thus, the sleep system that is most suitable for a particular person is that sleep system which provides the best possible combination of comfort and support to the person. Further, suitable sleep systems will vary considerably based on a person's physical attributes, sleeping habits, etc.

The number of factors that influence the suitability of a sleep system for a person are vast and interrelated. Thus, the selection of a suitable sleep system can be a complicated and difficult process for a person. Further, the sleep system that a person selects for themselves based on what sleep system feels most appealing to the person during a showroom testing of the sleep system may not be the most suitable sleep system for the person. Rather, it may require several weeks of sleeping on a given sleep system for a person to determine the long-term suitability of the sleep system. However, prospective sleep system purchasers are generally limited to such brief showroom testing.

Thus, there is a need for a way to objectively evaluate a person on a sleep system so as to determine the most suitable sleep system for the person. There is also a need for a way to evaluate a person for a sleep system in a showroom setting so as to facilitate the person's purchase of a suitable sleep system and to recommend the most suitable sleep system for the person.

SUMMARY

Methods and apparatuses consistent with the present invention relate to the evaluation of a person for a sleep system, the measurement and analysis of physical characteristics of a person on a sleep system, the determination of sleep system characteristics that are most suitable for the person, and the recommendation of a sleep system that is most suitable for the person. Methods and apparatuses consistent with the present invention also relate to measuring and analyzing the effect of a person on a mattress and a foundation and to providing a recommendation for a suitable sleep system using such an analysis.

According to an aspect of the present invention, a method for evaluating a person for a sleep system is provided, the method comprising: while the person is not positioned on an evaluating member, adjusting a pressure of a comfort layer inflatable member disposed within a comfort layer of the evaluating member to an initial comfort value; positioning the person on the evaluating member in a first position; while the person is positioned on the evaluating member in the first position, measuring a pressure of the comfort layer inflatable member as a first measured comfort value; calculating a difference between the first measured comfort value and the initial comfort value as $\Delta_{COMFORT\ PRESSURE\ 1}$; calculating a first optimal pressure level for the comfort layer inflatable member using $\Delta_{COMFORT\ PRESSURE\ 1}$; and recommending a sleep support member for the person using the calculated first optimal pressure level for the comfort layer inflatable member and using data measuring quality of sleep.

According to another aspect of the present invention, a method for evaluating a person for a sleep system is provided, the method comprising: while the person is not positioned on an evaluating member: adjusting a pressure of a comfort layer inflatable member disposed within a comfort layer of the evaluating member to a initial comfort value; and adjusting a pressure of a support layer inflatable member disposed within a support layer of the evaluating member to an initial support value; positioning the person on the evaluating member in a first position; while the person is positioned on the evaluating member in the first position: measuring a pressure of the comfort layer inflatable member as a first measured comfort value; and measuring a pressure of the support layer inflatable member as a first measured support value; calculating a difference between the first measured comfort value and the initial comfort value as $\Delta_{COMFORT\ PRESSURE\ 1}$; calculating a difference between the first measured support value and the initial support value as $\Delta_{SUPPORT\ PRESSURE\ 1}$; calculating a first optimal pressure level for the comfort layer inflatable member using $\Delta_{COMFORT\ PRESSURE\ 1}$; calculating a first optimal pressure level for the support layer inflatable member using $\Delta_{SUPPORT\ PRESSURE\ 1}$; and recommending a sleep support member for the person using the calculated first optimal pressure level for the comfort layer inflatable member and using the calculated first optimal pressure level for the support layer inflatable member.

BRIEF DESCRIPTION OF THE DRAWINGS

The above and other aspects of the present invention will become more apparent by describing in detail illustrative embodiments thereof with reference to the attached drawings in which.

DETAILED DESCRIPTION OF ILLUSTRATIVE EMBODIMENTS

Figure 1:
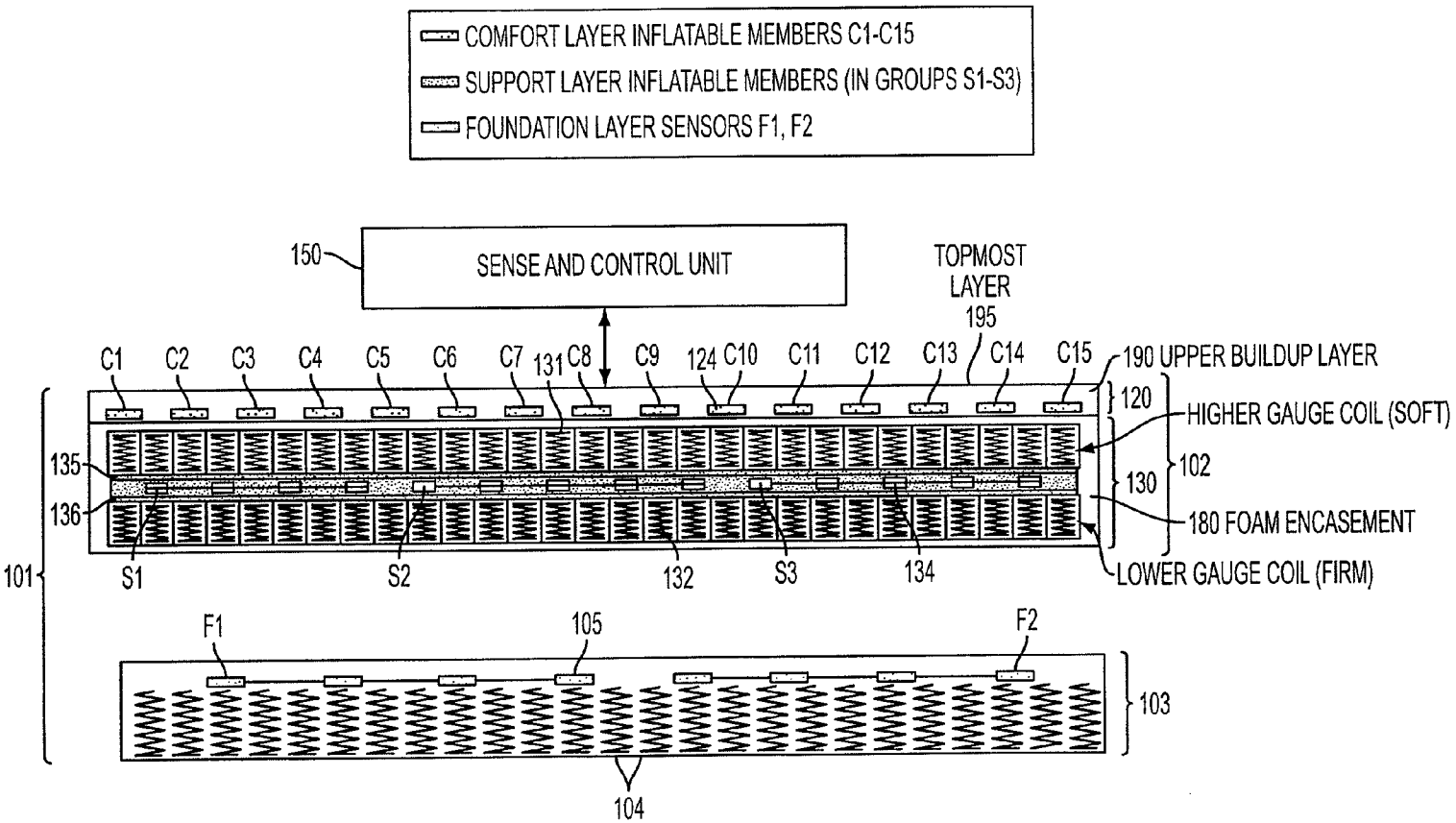
FIG. 1 illustrates a cross-sectional view of an apparatus for evaluating a person for a sleep system according to an illustrative embodiment of the present invention.

Illustrative embodiments of the invention will now be described in detail with reference to the attached drawings in which like reference numerals refer to like elements.

Aspects of the present invention provide a method and apparatus for evaluating a person for a sleep system. FIG. 1 illustrates a cross-sectional view of an apparatus for evaluating a person for a sleep system consistent with an illustrative embodiment of the present invention. As shown in FIG. 1, a test bed 101 for evaluating a person for a sleep system comprises a mattress layer 102 and a foundation layer 103, which is disposed below the mattress layer 102. According to an illustrative embodiment, the test bed 101 is an apparatus designed to simulate various components of a sleep system and to evaluate the characteristics of a person positioned on the test bed 101. As shown in FIG. 1, the test bed 101 is connected to a sense and control unit 150.

By way of illustration, the test bed 101 may be employed in a bedding store showroom to assist purchasers in the selection of sleep system components such as a mattress, a box spring unit, or a pillow. The test bed 101 may also be employed to assist salespersons in providing recommendations to purchasers regarding the suitability of particular sleep system components currently in stock. Further, the test bed 101 may be employed to measure and analyze the particular characteristics of a person so that a customized sleep system may be designed and manufactured for the person.

According to one illustrative embodiment, as shown in FIG. 1, the foundation layer 103 is configured to simulate a box spring of a sleep system. The foundation layer 103 comprises a plurality of foundation coils 104. According to the illustrative embodiment shown in FIG. 1, the layer of foundation coils 104 is arranged in rows of coils that extend in a longitudinal direction of the test bed 101 (i.e., the rows of coils extend from the head of the test bed 101 to the foot of the test bed 101). However, the present invention is not limited to this illustrative configuration of coils and the rows of coils comprising the layer of foundation coils 104 may extend laterally across the width of the test bed 101 consistent with the present invention. More generally, the rows of coils comprising the layer of foundation coils 104 may comprise any arrangement of coils and the present invention is not limited to any specific configuration of coils.

The foundation layer 103 further comprises a plurality of foundation sensors 105, which are configured to measure the amount of pressure applied to the foundation sensors 105. In particular, each of the foundation sensors 105 is configured to provide real time measurements relating to the amount of pressure applied by the mattress layer 102 to various positions on the foundation layer 103. Such pressure may be applied, for example, as a result of a person positioned on the mattress layer 102.

According to the illustrative embodiment shown in FIG. 1, the foundation layer 103 comprises eight foundation sensors 105, but the present invention is not limited to this configuration and a larger or smaller number of foundation sensors 105 may be employed consistent with the present invention. Further, according to the illustrative embodiment shown in FIG. 1, the plurality of foundation sensors 105 are grouped into two groups, F1 and F2, but the present invention is not limited to this configuration and a wide variety of groupings of the foundation sensors 105 may be employed, or the foundation sensors 105 need not be grouped at all. Consistent with the present invention, measurements obtained by the foundation sensors 105 allow for, among other things, evaluation of a person that is positioned on the test bed 101. In particular, the foundation sensors 105 allow an evaluation of the pressure applied the foundation layer 103. Measurements obtained by the foundation sensors 105 also allow for the identification of the foundation or box spring unit that is most suitable for the person.

According to one illustrative embodiment, as shown in FIG. 1, the mattress layer 102 is configured to simulate a typical mattress of a sleep system. As shown in FIG. 1, the mattress layer 102 comprises a comfort measurement/adjustment layer 120 and a support measurement/adjustment layer 130 that is disposed below the comfort measurement/adjustment layer 120.

The comfort measurement/adjustment layer 120 and the support measurement/adjustment layer 130 are configured to allow measurement and adjustment of (among a wide variety of other measurements) the two primary components of sleep systems mentioned above that affect a person's overall sleep experience, namely, comfort and support.

The comfort measurement/adjustment layer 120 is configured to measure and adjust the pressure applied to a top region of the test bed 101 at various regions of the person's body while a person is positioned on the test bed 101. More particularly, the comfort measurement/adjustment layer 120 is configured to allow immediate measurements and adjustments to the region of a sleep system that typically delivers comfort to a person's body through the use of comfort layers at a top region of the sleep surface. The comfort measurement/adjustment layer 120 is configured to simulate varying types of such comfort layers.

In contrast, the support measurement/adjustment layer 130 is configured to measure and adjust the pressure applied to a region of the test bed 101 below the comfort measurement/adjustment layer 120 at various regions of the person's body while a person is positioned on the test bed 101. More particularly, the support measurement/adjustment layer 130 is configured to allow immediate measurements and adjustments to the region of a sleep system that typically delivers support to a person's body through the resistance provided by the innersprings. The support measurement/adjustment layer 130 is configured to simulate varying levels of support that can be provided by a sleep system.

As explained in detail below, by measuring and adjusting both the comfort measurement/adjustment layer 120 and the support measurement/adjustment layer 130, it is possible to determine the sleep system that provides the best possible combination of comfort and support to the person.

As shown in FIG. 1, the support measurement/adjustment layer 130 comprises a layer of mattress upper coils 131 and a layer of mattress lower coils 132. According to the illustrative embodiment shown in FIG. 1, the layer of mattress upper coils 131 and the layer of mattress lower coils 132 are arranged in rows of coils that extend in a longitudinal direction of the test bed 101 (i.e., the rows of coils extend from the head of the test bed 101 to the foot of the test bed 101). However, the present invention is not limited to this illustrative configuration of coils and the rows of coils comprising the layer of mattress upper coils 131 and the layer of mattress lower coils 132 may extend laterally across the width of the test bed 101 consistent with the present invention. More generally, the rows of coils comprising the layer of mattress upper coils 131 and the layer of mattress lower coils 132 may comprise any arrangement of coils and the present invention is not limited to any specific configuration of coils.

Further, according to one illustrative embodiment, the coils comprising the layer of mattress upper coils 131 and the layer of mattress lower coils 132 comprise what is known in the industry as pocketed coil springs in which each spring is individually enclosed within a pocket of material. However, the present invention is not limited to a configuration employing pocketed coils and a wide variety of support devices can be used consistent with the present invention, including, but not limited to, layers of plastic based materials or other engineered support systems.

According to the illustrative embodiment shown in FIG. 1, the coils comprising the layer of mattress upper coils 131 are formed of a higher gauge material than the coils comprising the layer of mattress lower coils 132. For example, the coils comprising the layer of mattress upper coils 131 may be formed of 16 gauge wire (i.e., softer coils), whereas the coils comprising the layer of mattress lower coils 132 may be formed of 14 gauge wire (i.e., firmer coils). As such, when force is applied to the top of the mattress layer 102 (e.g., when a person lies down on the test bed 101), the coils comprising the layer of mattress upper coils 131 compress more easily than the coils comprising the layer of mattress lower coils 132.

A plurality of support layer inflatable members or bladders 134 are disposed between the layer of mattress upper coils 131 and the layer of mattress lower coils 132. As shown in FIG. 1, there are three groups of support layer inflatable members 134, which are respectively referenced as S1, S2 and S3. However, the present invention is not limited to the configuration shown in FIG. 1 and any number of groups of support layer inflatable members 134 may be employed. According to the illustrative embodiment shown in FIG. 1, the support layer inflatable members 134 are pneumatic and are connected to a pump/vacuum unit 310 (shown in FIG. 3) via pneumatic tubes. However, the present invention is not limited to this illustrative configuration and other gasses or fluids besides air may be used to inflate/deflate the support layer inflatable members 134 to a desired pressure. The support layer inflatable members 134 may be constructed of a variety of materials including, but not limited to plastic, vinyl, neoprene, rubber and the like. According to the illustrative embodiment shown in FIG. 1, the support layer inflatable members 134 extend in a lateral direction across the width of the test bed 101.

Figure 8:
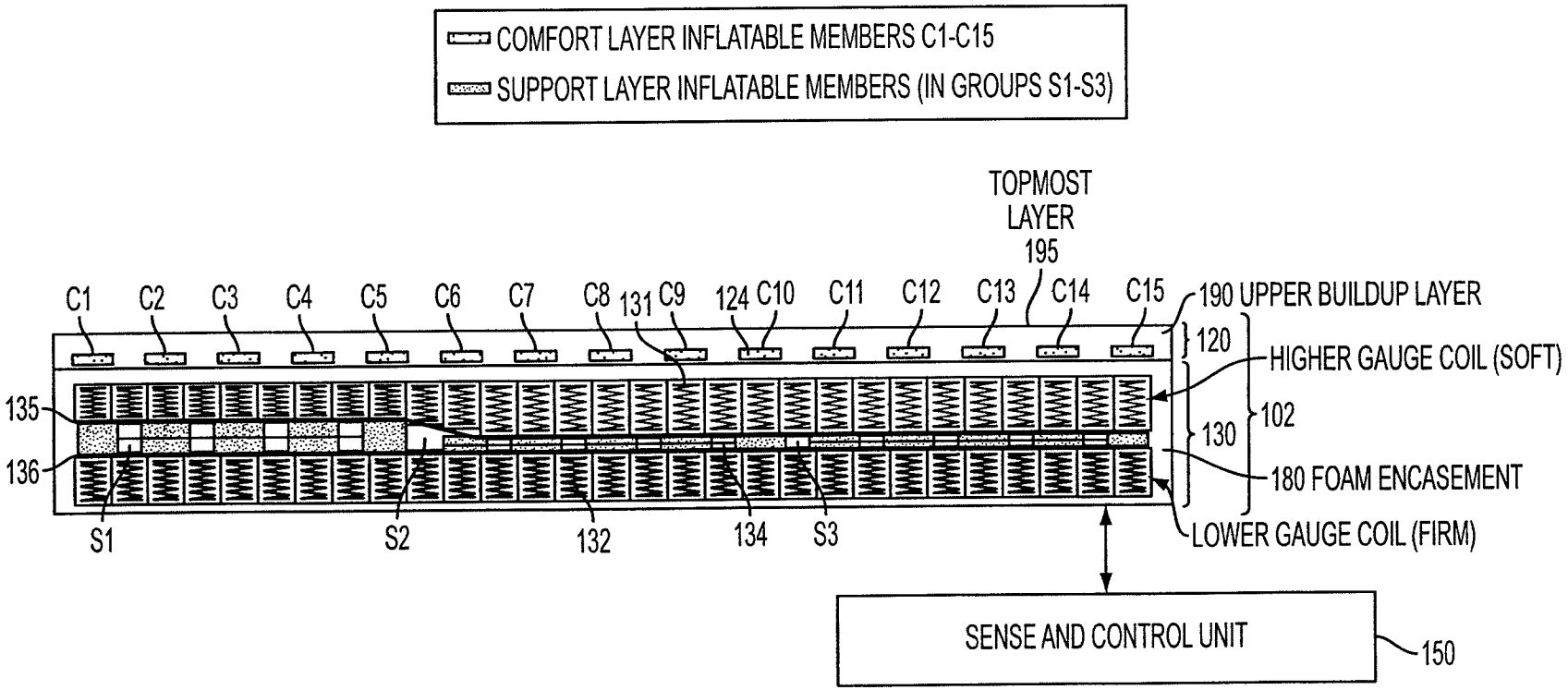
FIG. 8 illustrates a cross-sectional view of an apparatus for evaluating a person for a sleep system wherein a group S1 of support layer inflatable members are inflated according to an illustrative embodiment of the present invention.

As shown in FIGS. 1 and 8, the support layer inflatable members 134 are configured such that, when inflated, the support layer inflatable members 134 apply forces to the layer of mattress upper coils 131 and to the layer of mattress lower coils 132. FIG. 1 illustrates a cross-sectional view of the test bed 101 wherein a group S1 of support layer inflatable members 134 are deflated. On the other hand, FIG. 8 illustrates a cross-sectional view of the test bed 101 wherein the group of inflatable members S1 is inflated.

Accordingly, by controlling the inflation/deflation of the support layer inflatable members 134, the support characteristics of the test bed 101 can be adjusted. For example, if it is desired to provide more support for the person's lower back region, then the support layer inflatable members 134 disposed under the person's lower back region can be controlled to further inflate. Consequently, the support layer inflatable members 134 apply greater forces to the coils within the layer of mattress upper coils 131 and the layer of mattress lower coils 132 that are disposed under the person's lower back region, causing the aforementioned coils to further compress and, in turn, apply greater support to the person's lower back region.

Figure 3:
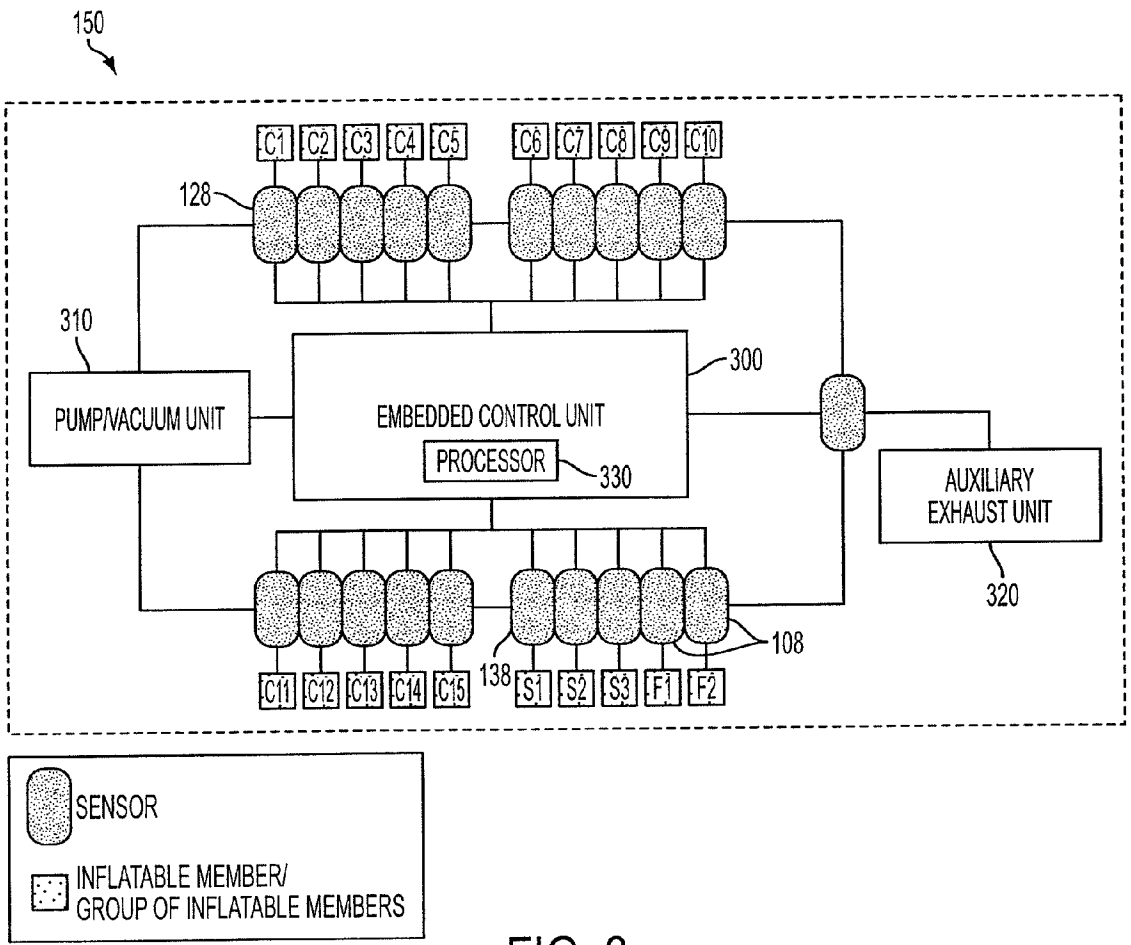
FIG. 3 illustrates a schematic diagram of a sense and control unit according to an illustrative embodiment of the present invention.

Further, as shown in FIG. 1, the test bed 101 is connected to a sense and control unit 150. A detailed illustration of the sense and control unit 150 is shown in FIG. 3. As shown in FIG. 3, the sense and control unit 150 comprises a plurality of comfort layer sensors 128, which are respectively associated with the comfort layer inflatable members 124, which are respectively referenced as C1, C2, C3, C4, C5, C6, C7, C8, C9, C10, C11, C12, C13, C14 and C15. The sense and control unit 150 further comprises a plurality of support layer sensors 138, which are respectively associated with the groups S1, S2 and S3 of support layer inflatable members 134. The sense and control unit 150 also comprises a plurality of foundation layer sensors 105, which are respectively referenced as F1 and F2.

As further illustrated in FIG. 3, the sense and control unit 150 comprises an embedded control unit 300, a pump/vacuum unit 310 and an auxiliary exhaust unit 320. The embedded control unit further comprises a processor 330. The pump/vacuum unit 310 may be controlled by the embedded control unit 300 to pump or suck air as desired to/from the support layer inflatable members 134 and the comfort layer inflatable members 124. The auxiliary exhaust unit 320 actively or passively exhausts gas or fluid from the support layer inflatable members 134 and the comfort layer inflatable members 124.

As shown in FIGS. 1 and 3, each of the plurality of support layer sensors 138 are connected to a respective group of the support layer inflatable members 134. For example, a group of five support layer inflatable members 134 on the left region of the test bed 101, as shown in FIG. 1, is connected to the support layer sensor S1, as shown in FIGS. 1 and 3. Likewise, a group of five support layer inflatable members 134 in the center region of the test bed 101, as shown in FIG. 1, is connected to the support layer sensor S2. Further, a group of five support layer inflatable members 134 on the right side of the test bed 101, as shown in FIG. 1, is connected to the support layer sensor S3. However, the present invention is not limited to the specific configuration shown in FIGS. 1 and 3 and a wide variety of groupings of the support layer sensors 138 may be used consistent with the present invention. Moreover, each of the plurality of support layer sensors 138 can be connected to a respective one of the support layer inflatable members 134.

Each of the support layer sensors 138 is configured to provide real time measurements relating to the pressure of a respective support layer inflatable member 134 or a respective group of support layer inflatable members 134. As such, when a person is positioned on the test bed 101 measurements relating to the pressure of respective support layer inflatable members 134 can be acquired and analyzed. Using such measurements, a support layer pressure profile of the person can be obtained and used to determine the most suitable sleep system support layer characteristics for the person.

According to the illustrative embodiment shown in FIG. 1, the support measurement/adjustment layer 130 comprises fifteen support layer inflatable members 134, but the present invention is not limited to this configuration and a larger or smaller number of support layer inflatable members 134 may be employed consistent with the present invention.

According to the illustrative embodiment illustrated in FIG. 1, each support layer inflatable member 134 is configured to apply forces to a plurality of rows of mattress upper coils 131 and to a plurality of rows of mattress lower coils 132. That is, each support layer inflatable member 134 is aligned with more than one row of coils. Alternatively, each support layer inflatable member 134 can be positioned without regard to the position of the individual coils of the layer of mattress upper coils 131 and the layer of mattress lower coils 132. In one embodiment, the support layer inflatable members 134 may be attached to the coils of the layer of mattress upper coils 131 and to the layer of mattress lower coils 132, for example, by gluing each support layer inflatable member 134 to the coils.

Moreover, a first force dispersing cover 135 may be disposed between the support layer inflatable members 134 and the coils of the layer of mattress upper coils 131. Among other things, the first force dispersing cover 135 facilitates the dispersion of the force applied by each support layer inflatable member 134 among a plurality of rows of mattress upper coils 131. The first force dispersing cover 135 may be comprised of a wide variety of materials including, but not limited to, non-woven fabric, polystyrene, etc.

Likewise, a second force dispersing cover 136 may be disposed between the support layer inflatable members 134 and the layer of mattress lower coils 132. Among other things, the second force dispersing cover 136 facilitates the dispersion of the force applied by each support layer inflatable member 134 among a plurality of rows of mattress lower coils 132.

According to one illustrative embodiment, the first force dispersing cover 135 may be glued to the coils of the layer of mattress upper coils 131 and the second force dispersing cover 136 may be glued to the layer of mattress lower coils 132. By inserting the first and second force dispersing covers 135 and 136 between the coils and the inflatable members, the force applied by expanding each respective inflatable member is spread over a greater area and hence across a greater number of coils. In this illustrative configuration, the first and second force dispersing covers 135 and 136 disperse the force of the inflatable members to achieve a greater effect on the coils over a greater area.

FIG. 1 also shows an illustrative embodiment wherein the layer of mattress upper coils 131, the layer of mattress lower coils 132 and the support layer inflatable members 134 are enclosed by a foam encasement 180.

As shown in FIG. 1, an upper buildup layer 190 is disposed above the layer of mattress upper coils 131. The upper buildup layer 190 comprises a plurality of comfort layer inflatable members 124 that are disposed above the layer of mattress upper coils 131 and below a topmost layer 195. The configuration of each of the respective comfort layer inflatable members 124 is similar to the configuration of the support layer inflatable members 134, discussed above.

Consistent with the illustrative embodiment depicted in FIG. 1, the comfort layer inflatable members 124 are configured such that, when inflated, the comfort layer inflatable members 124 apply forces to the layer of mattress upper coils 131, to the upper buildup layer 190 and to the topmost layer 195. Accordingly, by controlling the inflation/deflation of the comfort layer inflatable members 124 the comfort characteristics of the test bed 101 can be adjusted. For instance, the inflation/deflation of the comfort layer inflatable members 124 can be controlled to change the comfort level of the test bed 101 by making the comfort measurement/adjustment layer 120 either firmer or softer. That is, inflating or deflating a respective one of the comfort layer inflatable members 124 has the effect of compressing or decompressing upper buildup layer 190 and thereby creating a different interface profile (or feel) for the occupant of the test bed 101.

Thus, if the sense and control unit 150 determines to make the comfort measurement/adjustment layer 120 firmer under the shoulder region of the person, then the respective comfort layer inflatable member(s) 124 under the person's shoulder region is/are further inflated. On the other hand, if the sense and control unit 150 determines to make the comfort measurement/adjustment layer 120 softer under the shoulder region of the person, then the respective comfort layer inflatable member(s) 124 under the person's shoulder region is/are further deflated so as to have more cushion in those areas.

Additionally, as shown in shown in FIGS. 1 and 3, each of a plurality of comfort layer sensors 128 are connected to a respective one of the comfort layer inflatable members 124. Each of the comfort layer sensors 128 is configured to provide real time measurements relating to the pressure of a respective comfort layer inflatable member 124. According to the illustrative embodiment shown in FIGS. 1 and 3, the fifteen comfort layer inflatable members 124 are connected to fifteen comfort layer sensors 128. However, the present invention is not limited to this configuration and a larger or smaller number of comfort layer sensors 128 may be employed consistent with the present invention.

Moreover, as shown in FIG. 1, each of the comfort layer inflatable members 124 is aligned with a respective one of the support layer inflatable members 134, however, such alignment is not necessary and illustrative embodiments of the invention my comprise configurations of comfort layer inflatable members 124 and support layer inflatable members 134 that are not aligned.

Also, according to the illustrative embodiment shown in FIG. 1, the comfort layer inflatable members 124 need not be aligned with a respective row of the mattress upper coils 131. Indeed, a respective comfort layer inflatable member 124 may be aligned with more than one of the rows of mattress upper coils 131. Alternatively, the comfort layer inflatable members 124 can be positioned without regard to the position of the individual mattress upper coils 131.

Importantly, when a person is positioned on the test bed 101, measurements relating to the pressure of respective comfort layer inflatable members 124 can be acquired and analyzed. Using such measurements, a comfort layer pressure profile of the person can be obtained and used to determine the most suitable sleep system comfort layer characteristics for the person.

Consistent with the present invention, the support layer sensors 138 and the comfort layer sensors 128 provide the ability to measure a wide variety of data. For example, when a person is positioned on the test bed 101, data provided by the support layer sensors 138 and the comfort layer sensors 128 can be analyzed to determine, among other things, the person's weight, weight distribution, breathing rate, heart rate, state of sleep, etc.

Furthermore, although the illustrative embodiment shown in FIG. 1 comprises a foundation layer 103, a comfort measurement/adjustment layer 120 and a support measurement/adjustment layer 130, the present invention is not limited to this configuration. In fact, illustrative embodiments of the present invention may include only the foundation layer 103, or only the comfort measurement/adjustment layer 120, or only the support measurement/adjustment layer 130, or may include any combination of the aforementioned layers.

Figure 7A:
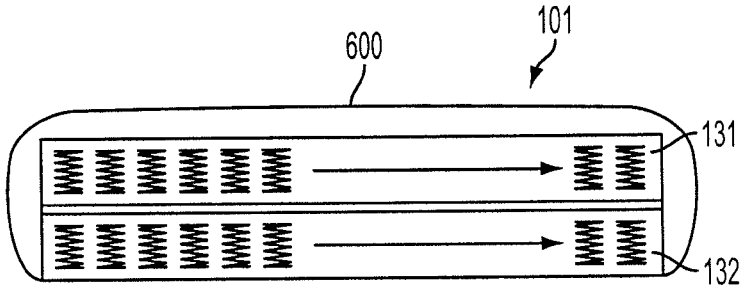
FIG. 7A illustrates a cross-sectional view of an apparatus for evaluating a person for a sleep system comprising a third force dispersing cover according to an illustrative embodiment of the present invention.
Figure 7B:
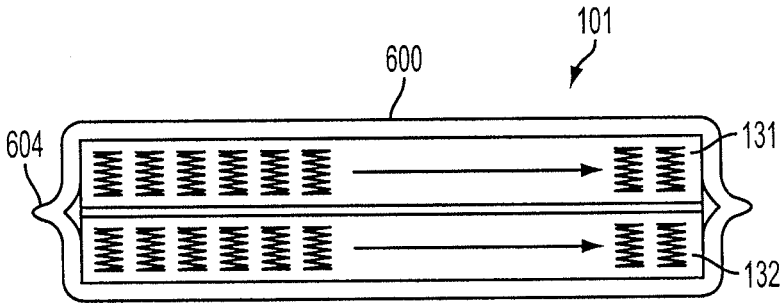
FIG. 7B illustrates a cross-sectional view of an apparatus for evaluating a person for a sleep system having a third force dispersing cover according to an illustrative embodiment of the present invention.

Additionally, according to an illustrative embodiment of the present invention, as shown in FIGS. 7A and 7B, the test bed 101 may comprise a third force dispersing cover 600, which is wrapped around the layer of mattress upper coils 131 and the layer of mattress lower coils 132. According to the illustrative embodiment shown in FIGS. 7A and 7B, the third force dispersing cover 600 extends the length of the test bed 101, but does not extend over the head or the foot of the test bed 101. As shown in FIGS. 7A and 7B, the third force dispersing cover 600 is, for illustrative purposes, shown as loosely surrounding the layer of upper coils 131 and the layer of lower coils 132. However, illustrative embodiments of the present invention may comprise a third force dispersing cover 600 that is tightly wrapped around the layer of upper coils 131 and the layer of lower coils 132. Among other things, the third force dispersing cover 600 disperses the forces applied by the mattress upper coils 131 and the layer of mattress lower coils 132 over a greater area of the foam encasement layer 180 (shown in FIG. 1) and, thus, helps to prevent a crowning effect that may occur at the top surface of the test bed 101.

According to the illustrative embodiment shown in FIG. 7A, the third force dispersing cover 600 is attached to a bottom border of the test bed 101 (e.g., border wire) and does not extend below the layer of lower coils 132.

Alternatively, according to the illustrative embodiment shown in FIG. 7B, the third force dispersing cover 600 extends below the layer of lower coils 132. Further, as shown in FIG. 7B, two opposing portions of the third force dispersing cover 600 are attached together at attachment portion 604. For example, the two opposing portions of the third force dispersing cover 600 may be attached via an ultrasonic weld, sewing, staples, etc. However, the present invention is not limited to the two exemplary configurations shown in FIGS. 7A and 7B and the third force dispersing cover 600 may assume a wide variety of configurations.

Figure 2:
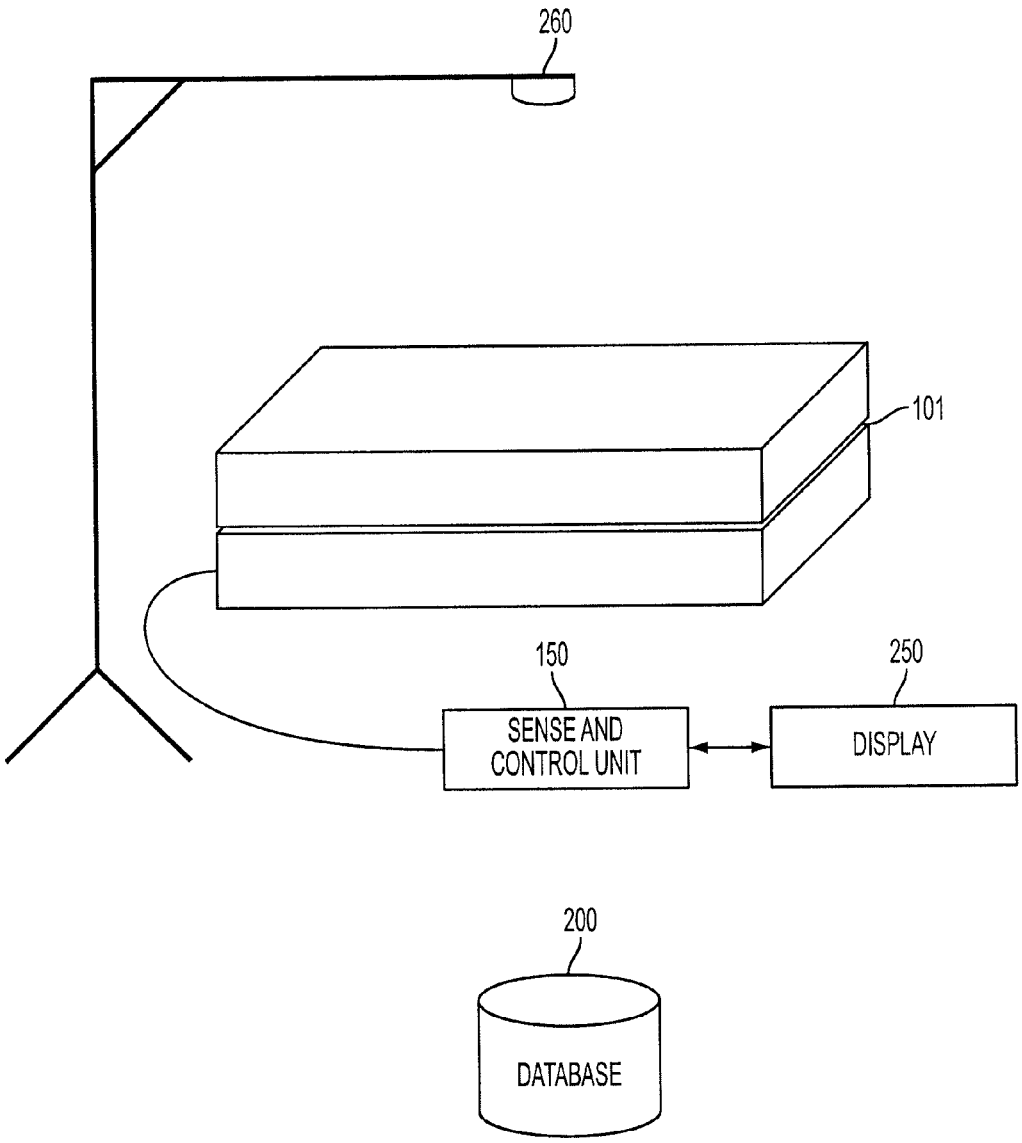
FIG. 2 illustrates a perspective view of an apparatus for evaluating a person for a sleep system according to an illustrative embodiment of the present invention.

FIG. 2 shows a perspective view of an apparatus for evaluating a person for a sleep system according to an illustrative embodiment of the present invention. As shown in FIG. 2, the support layer inflatable members 134, the support layer sensors 138, the comfort layer inflatable members 124, and the comfort layer sensors 128 are all connected to a sense and control unit 150. Further, as shown in FIG. 2, a display 250 is connected to the sense and control unit 150 and a database 200 is connected to the sense and control unit 150.

As shown in FIG. 2, a digital imaging device 260 is positioned near the test bed 101 so as to acquire a digital image of a person positioned on the test bed 101. The digital imaging device 260 is connected to the sense and control unit 150. According to an illustrative embodiment, the digital imaging device 260 is configured to acquire a digital image of a person positioned on the test bed 101. The sense and control unit 150 then controls the processor 330 to process the acquired digital image.

Although the use of a digital imaging device 260 to acquire a digital image of a person positioned on the test bed 101 has been described above, the present invention is not limited to this configuration. Indeed, any other device capable of measuring physical attributes of the person positioned on the test bed 101 may be used consistent with the present invention. Moreover, according to an illustrative embodiment, measurements regarding the physical attributes of the user can also be obtained by embedding additional sensors in the test bed 101 or by eliciting responses from the person to questions relating to their physical attributes. Further, illustrative embodiments of the present invention may employ scientific or statistical analysis techniques in place of the digital imaging device 260.

Figure 4:
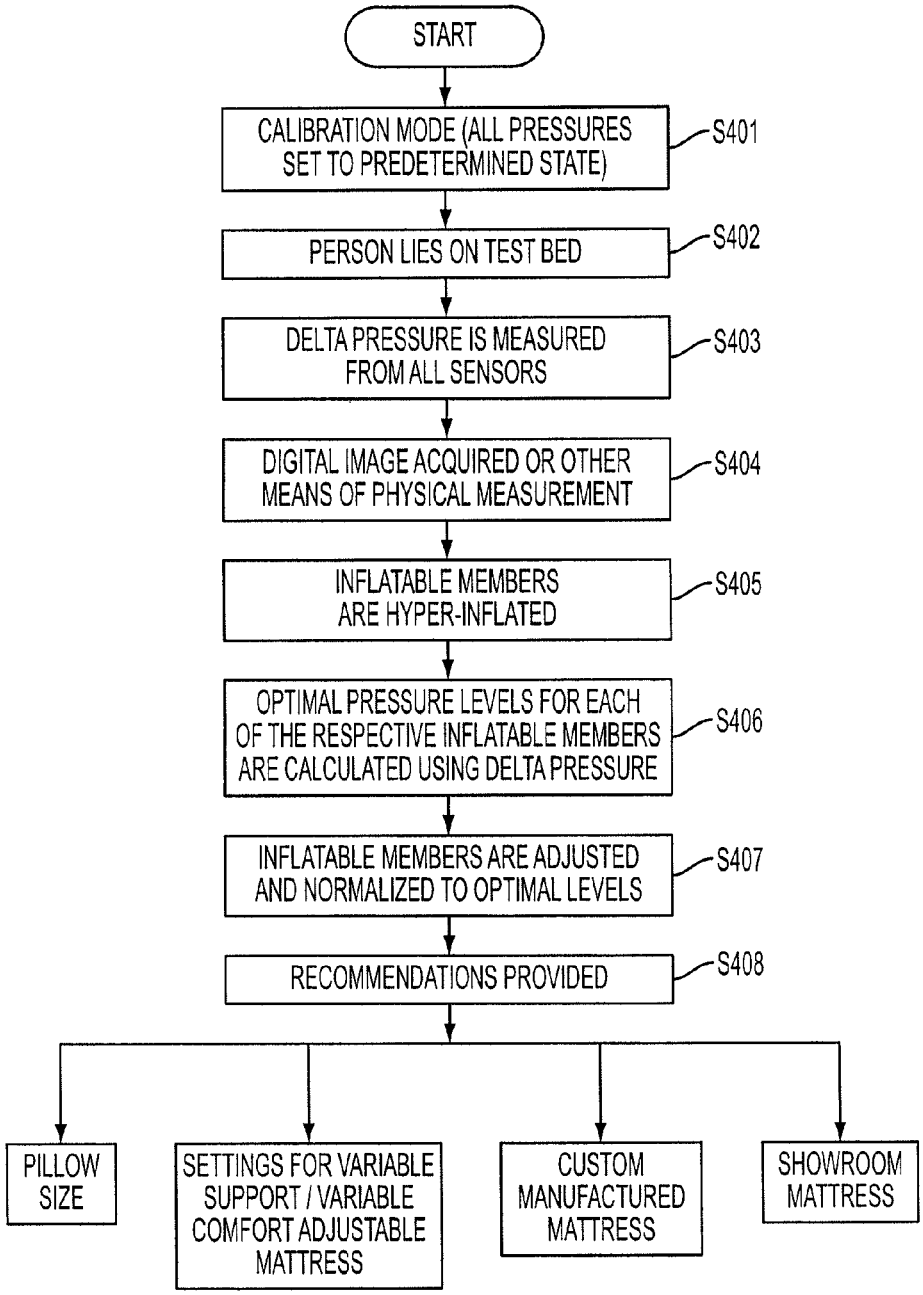
FIG. 4 illustrates a flow chart for a method of evaluating a person for a sleep system according to an illustrative embodiment of the present invention.

FIG. 4 shows a flow chart for a method of evaluating a person for a sleep system according to an illustrative embodiment of the present invention. As shown in FIG. 4, in operation S401, the sense and control unit 150 first initiates a calibration mode by inflating/deflating each of the respective support layer inflatable members 134 and comfort layer inflatable members 124 until the pressures of each of the inflatable members 134 and 124 are set to a predetermined state.

In operation S402, a person lies down on the test bed 101 and the person positions themselves in a particular position. For example, the person can position themselves on the test bed 101 lying on their back in a supine position, on their front, on their side or, more generally, any possible position.

In operation S403, once the person is positioned in a steady position and is substantially still, the sense and control unit 150 acquires measurement data from each of the foundation sensors 105, the support layer sensors 138, and the comfort layer sensors 128. Then, the processor 330 calculates a change in pressure ($\Delta_{Pressure}$) for each of the respective foundation sensors 105, support layer sensors 138, and comfort layer sensors 128. By applying various algorithms to the calculated change in pressure ($\Delta_{Pressure}$), the processor 330 can determine a variety of useful analytical measurements of the person.

By using the information collected by the sense and control unit 150, and in one illustrative embodiment also using a digital image acquired by the digital imaging device 260, which is discussed in greater detail below, the general body dimensions and weight distribution (among other things) of a person disposed on the test bed 101 can be statistically predicted. The processor 330 can use these statistically predicted values to determine the best combinations of zoned support and zoned comfort provided by the test bed 101 that is needed to produce a healthy sleep system. More generally, the processor 330 can analyze the overall effect of the person's body on various points on the mattress layer 102 and the foundation layer 103 using the measurement data acquired from each of the foundation sensors 105, the support layer sensors 138, and the comfort layer sensors 128.

In operation S404, the digital imaging device 260 acquires a digital image of the person as the person is positioned on the test bed 101. The acquired digital image is then processed by the processor 330 and, using various analytical algorithms, a variety of the person's physical attributes can be determined. For example, the processor 330 can determine the height of the person, the width of the person's shoulders, waist, hip and head, the distance from the person's head to shoulders, and the person's position on the test bed 101.

Next, in operation S405, all of the support layer inflatable members 134 and comfort layer inflatable members 124 are hyper-inflated while the person remains in a stable position on the test bed 101. This hyper-inflation causes the test bed 101 to "fill-in" or help learn the person's body while also preparing for the normalization process (discussed in detail below). Hyper inflation is basically a maximum pressure that may be varied depending on initial readings (much like a blood pressure device).

In operation S406, the optimal pressure levels for each of the respective support layer inflatable members 134 and comfort layer inflatable members 124 at which the test bed 101 provides optimal comfort and support characteristics to the person are calculated using the $\Delta_{Pressure}$ and the acquired digital image. However, illustrative embodiments of the present invention may also calculate the optimal pressure levels for each of the respective support layer inflatable members 134 and comfort layer inflatable members 124 without using the acquired digital image. For instance, other means of physical measurement may be used or the optimal pressure levels can be calculated using the $\Delta_{Pressure}$ alone.

Optimal comfort and support characteristics for respective persons can be determined, for example, by analyzing data obtained by observing a plurality of different persons of varying physical attributes (e.g., persons of different heights, weights, weight distributions, waist widths, shoulder widths, etc.) as they are positioned on a variety of different sleep systems, in a variety of different sleeping positions and by recording observed data in the database 200. By recording such observed data in the database 200, along with which particular sleep system(s) provide each respective person with the best support (e.g., spinal alignment, etc.) and comfort characteristics (e.g., lowest amount of interface pressure, etc.) a correspondence between particular physical attributes of persons and suitable sleep systems can be established and stored in the database 200.

Examples of analysis systems that measure the attributes of persons and aid in bed selection can be found in U.S. Pat. No. 6,571,192 to Hinshaw et al. (hereinafter "the '192 patent), U.S. Pat. No. 6,741,950 to Hinshaw et al. (hereinafter "the '950 patent), U.S. Pat. No. 6,990,425 to Hinshaw et al. (hereinafter "the '425 patent), and U.S. Pat. No. 6,585,328 to Oexman et al. (hereinafter "the '328 patent"), which are incorporated herein by reference in their entirety. As discussed in the '192 patent, the '950 patent and the '425 patent, test beds acquire pressure reading data for a plurality of zones and such data are processed to recommend one of a plurality of mattresses based on the closest fit of the data. Further, as discussed in the '328 patent, a system allows a retail mattress store to collect data from a sensor pad positioned on top of a support surface to generate a pressure profile for that person. The pressure profile and other information are used to generate specific mattress design parameters or coefficients which are then utilized in designing a specific mattress uniquely customized for that person. However, the '192 patent, the '950 patent, the '425 patent and the '328 patent are merely examples of analysis systems and the present invention is not limited to these examples.

According to one illustrative embodiment, the optimal comfort and support characteristics for respective persons can be determined using anthropometric data. Examples of such anthropometric data are provided by the publications "Humanscale 1/2/3" by Niels Diffrient et al., MIT Press, copyright 1974, "Humanscale 4/5/6" by Niels Diffrient et al., MIT Press, copyright 1981, "The Measure of Man & Woman," Revised Edition, Alvin R. Tilley, John Wiley & Sons, Inc., copyright 2002, which are incorporated herein by reference in their entirety.

In operation S407, the processor 330 adjusts and normalizes each of the support layer inflatable members 134 and comfort layer inflatable members 124 to the calculated optimal pressure levels so that the test bed 101 provides optimal comfort and support characteristics to the person.

Finally, in operation S408, the sense and control unit 150 causes recommendations to be provided to the person via the display 250 regarding suitable sleep system products that provide the optimal comfort and support characteristics that were calculated in operation S406. For example, recommendations can be provided regarding the pillow size and pillow type that is most suitable for the person. Further, recommendations can be provided regarding the most suitable variable support and variable comfort settings to which a variable support/variable comfort sleep system can be adjusted. A variable support/variable comfort sleep system has been developed by the inventors of the present application, as set forth in a related Provisional Application entitled, "Apparatuses and Methods Providing Variable Support and Variable Comfort Control of a Sleep System and Automatic Adjustment Thereof," which is incorporated herein by reference in its entirety.

Recommendations can also be provided regarding a customized non-adjustable mattress than can be custom manufactured for the person. Alternatively, recommendations can be provided regarding which type of conventional mattresses currently in the showroom will provide the most suitable support and comfort characteristics to the person.

Figure 5:
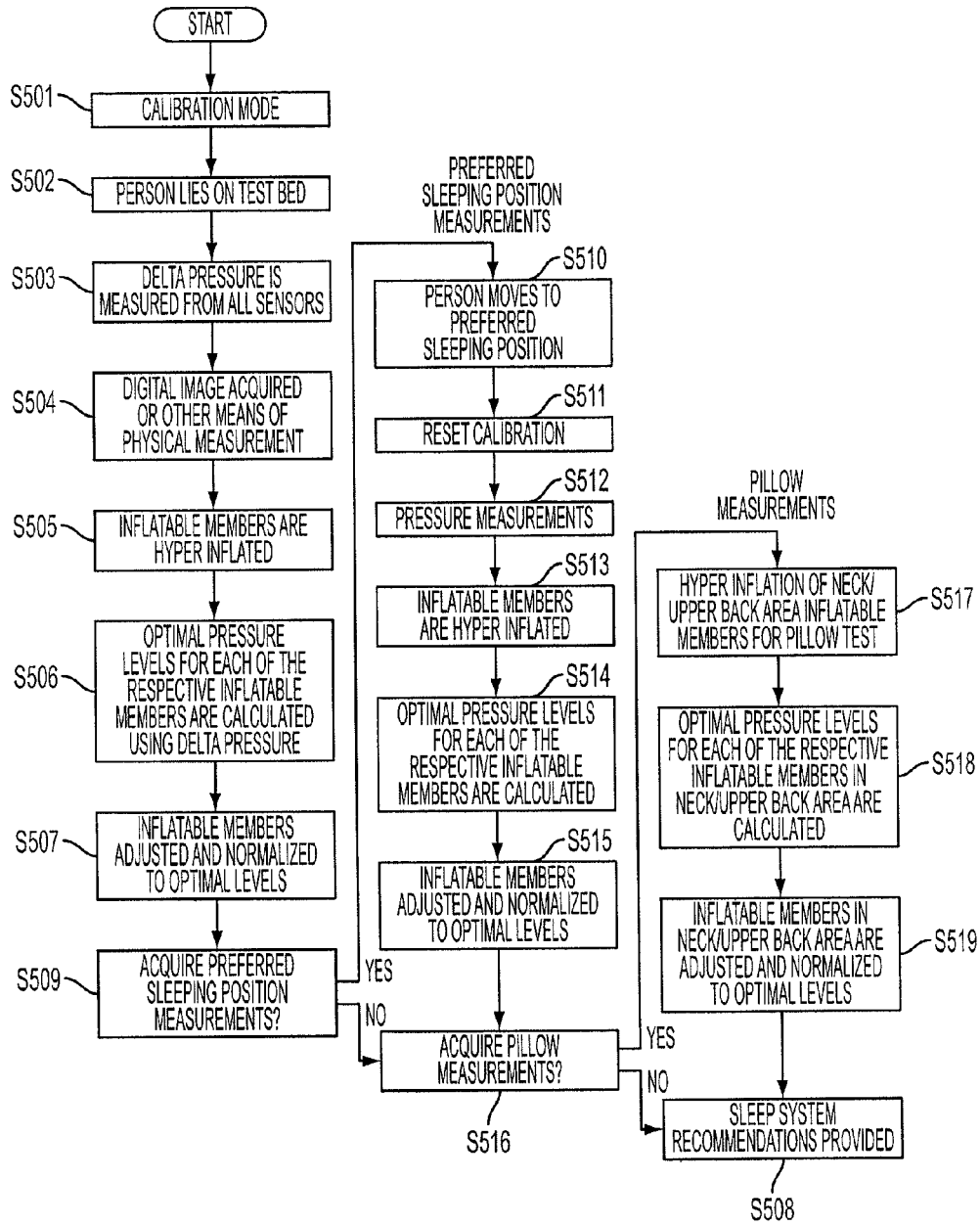
FIG. 5 illustrates a second flow chart for a method of evaluating a person for a sleep system according to an illustrative embodiment of the present invention.

FIG. 5 illustrates a second flow chart for a method of evaluating a person for a sleep system according to an illustrative embodiment of the present invention. As shown in FIG. 5, the operations 5501, S502, S503, S504, S505, S506, S507 and S508 are analogous to operations S401, S402, S403, S404, S405, S406, S407 and S408 discussed above with reference to FIG. 4. However, the flow chart illustrated in FIG. 5 differs from FIG. 4 in that, among other differences, after operation S507, wherein the processor 330 adjusts and normalizes each of the support layer inflatable members 134 and comfort layer inflatable members 124 to the calculated optimal pressure levels, the sense and control unit 150 then determines whether an instruction to acquire preferred sleeping position measurements has been received in operation S509.

If the sense and control unit 150 has not received an instruction to acquire preferred sleeping position measurements (operation S509=NO) then operation S516 is performed.

However, if the sense and control unit 150 has received an instruction to acquire preferred sleeping position measurements (operation S509=YES) then operation S510 is performed, wherein the person moves to a preferred sleeping position. For example, if the person typically prefers to sleep on their side, then the person moves to a position on their side. On the other hand, if the person typically prefers to sleep on their front, for instance, then the person moves to a position on their front in a prone position.

Then, in operation S511, once the person is positioned in a steady position and is substantially still, the sense and control unit 150 initiates a reset calibration mode by inflating/deflating each of the respective support layer inflatable members 134 and comfort layer inflatable members 124 until the pressures of each of the inflatable members 134 and 124 are set to a predetermined state.

Next, in operation S512, the sense and control unit 150 acquires measurement data from each of the foundation sensors 105, the support layer sensors 138, and the comfort layer sensors 128. By using the information collected by the sense and control unit 150 and the digital image acquired by a digital imaging device 260, the processor 330 again analyzes the overall effect of the person's body on various points on the mattress layer 102 and the foundation layer 103.

In operation S513, all of the support layer inflatable members 134 and comfort layer inflatable members 124 are again hyper-inflated while the person remains in a stable position on the test bed 101.

Then, in operation S514, the optimal pressure levels for each of the respective support layer inflatable members 134 and comfort layer inflatable members 124 at which the test bed 101 provides optimal comfort and support characteristics to the person, while the person is positioned in their preferred sleeping position, are calculated.

In operation S515, the processor 330 adjusts and normalizes each of the support layer inflatable members 134 and comfort layer inflatable members 124 to the calculated optimal pressure levels so that the test bed 101 provides optimal comfort and support characteristics to the person, while the person is positioned in their preferred sleeping position.

In operation S516, the sense and control unit 150 determines whether an instruction to acquire pillow measurements has been received. If the sense and control unit 150 has not received an instruction to acquire pillow measurements (operation S516=NO) then operation S508 is performed and recommendations are provided to the person via the display 250 regarding suitable sleep system products that provide the optimal comfort and support characteristics that were calculated by the processor 330 in operation S506 and in operation S514.

If the sense and control unit 150 has received an instruction to acquire pillow measurements (operation S516=YES) then operation S517 is performed, wherein the support layer inflatable members 134 and comfort layer inflatable members 124, located in regions corresponding to the neck and upper back region of the person, are hyper-inflated while the person remains in a stable position on the test bed 101.

Then, in operation S518 the optimal pressure levels for each of the respective support layer inflatable members 134 and comfort layer inflatable members 124, located in areas corresponding to the neck and upper back region of the person, at which the test bed 101 provides optimal comfort and support characteristics to the person, are calculated.

In operation S519, the processor 330 adjusts and normalizes each of the support layer inflatable members 134 and comfort layer inflatable members 124, located in areas corresponding to the neck and upper back region of the person, to the calculated optimal pressure levels so that the test bed 101 provides optimal comfort and support characteristics to the person in areas corresponding to the neck and upper back region of the person.

Finally, operation S508 is performed and recommendations are provided to the person via the display 250 regarding suitable sleep system products that provide the optimal comfort and support characteristics that were calculated by the processor 330 in operation S506, in operation S514, and in operation S518. Although the illustrative embodiments described above relate to the evaluation of one person for a sleep system, the present invention can also be employed to evaluate multiple persons for a sleep system. For example, apparatuses and methods consistent with the present invention may be used to evaluate a person and a sleeping partner on a sleep system. According to one illustrative embodiment, the test bed 101 may comprise two separate testing surfaces so that one or two persons can be evaluated at the same time. Thus, apparatuses and methods consistent with the present invention can recommend a sleep system that provides optimal comfort and support characteristics to both a person and their sleeping partner.

Figure 6:
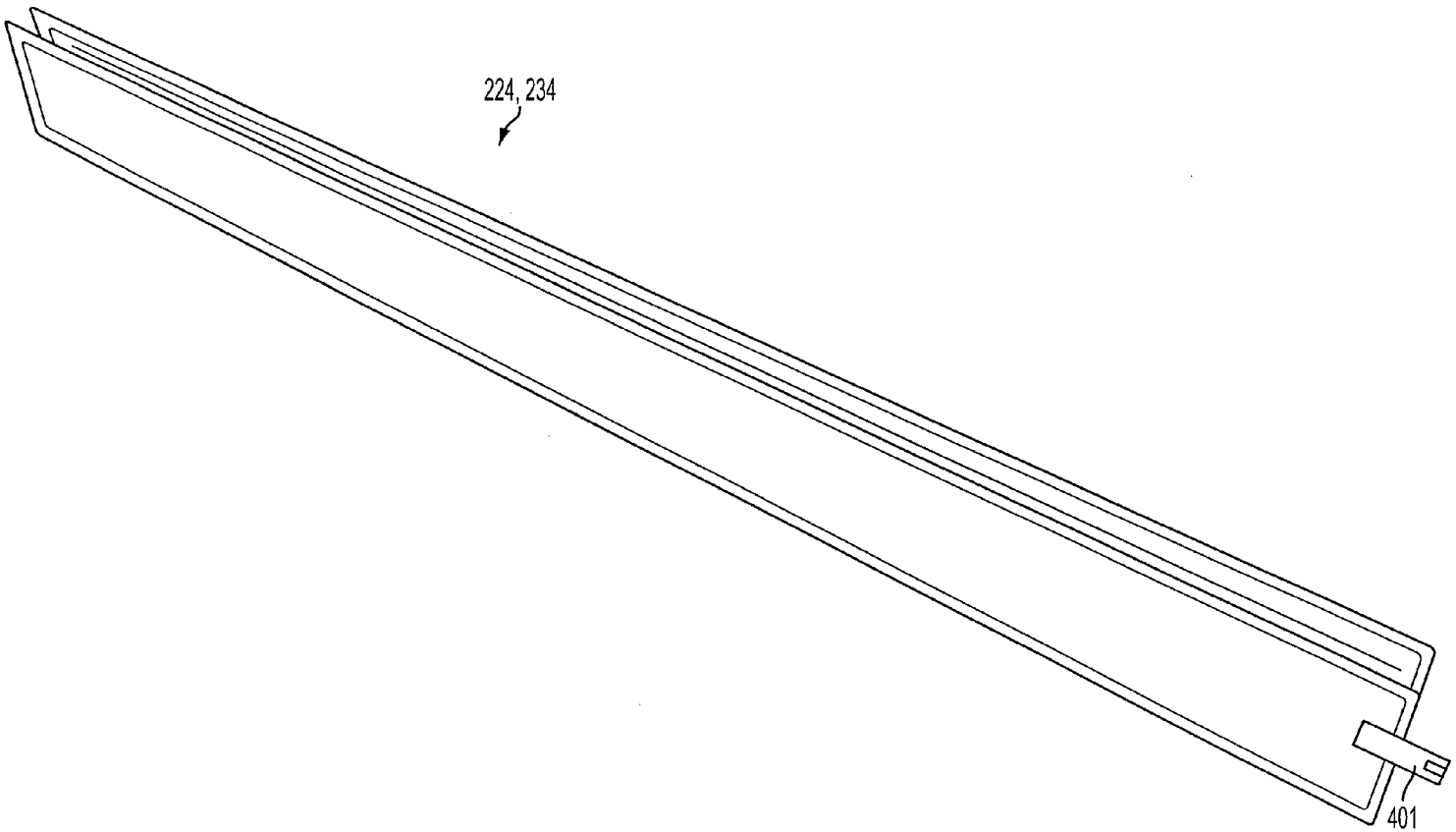
FIG. 6 illustrates a view of an inflatable member according to an illustrative embodiment of the present invention.

FIG. 6 illustrates a view of an inflatable member 124 or 134 according to an illustrative embodiment of the present invention. Although one illustrative shape and configuration of the inflatable member is shown in FIG. 6, the inflatable members 124 and 134 may assume other shapes and configurations consistent with the present invention. Further, the comfort layer inflatable members 124 may assume shapes and/or configurations that are different from the shapes and/or configurations of the support layer inflatable members 134. As shown in FIG. 6, each of the inflatable members comprises a valve 401.

Figure 9A:
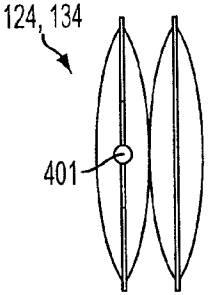
FIG. 9A illustrates a side view of one end of an inflatable member according to an illustrative embodiment of the present invention.
Figure 9B:
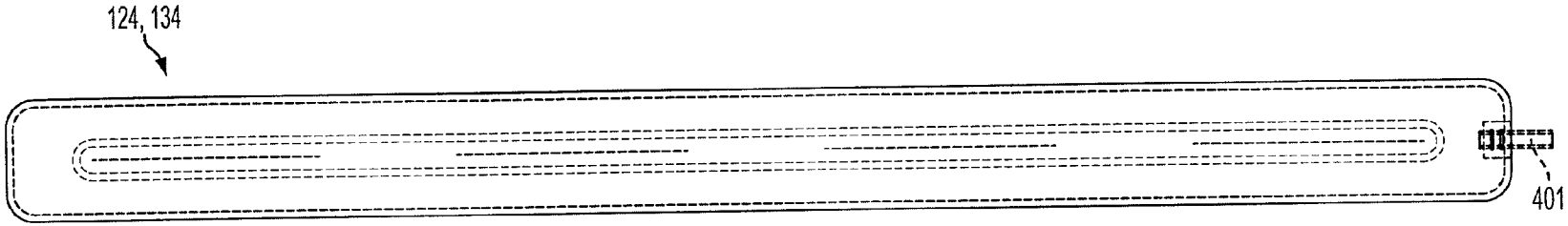
FIG. 9B illustrates a top view of an inflatable member according to an illustrative embodiment of the present invention.

FIG. 9A illustrates a side view of one end of an inflatable member 124 or 134 according to an illustrative embodiment of the present invention. FIG. 9B illustrates a top view of an inflatable member 124 or 134 according to an illustrative embodiment of the present invention.

While the present invention has been particularly shown and described with reference to illustrative embodiments thereof, it will be understood by those of ordinary skill in the art that various changes in form and details may be made therein without departing from the spirit and scope of the invention as defined by the appended claims. The illustrative embodiments should be considered in a descriptive sense only and not for purposes of limitation. Therefore, the scope of the invention is defined not by the detailed description of the invention but by the claims set forth in the related non-provisional application and all differences within the scope will be construed as being included in the present invention.

What is claimed is:

1. A method for evaluating a person for a sleep system, the method comprising:

while the person is not positioned on an evaluating member, adjusting a pressure of a comfort layer inflatable member disposed within a comfort layer of the evaluating member to an initial comfort value;

positioning the person on the evaluating member in a first position;

while the person is positioned on the evaluating member in the first position, measuring a pressure of the comfort layer inflatable member as a first measured comfort value;

calculating a difference between the first measured comfort value and the initial comfort value as $\Delta_{COMFORT\ PRESSURE\ 1}$;

calculating, using at least one processor, a first optimal pressure level for the comfort layer inflatable member using $\Delta_{COMFORT\ PRESSURE\ 1}$; and recommending, using the at least one processor, a sleep support member for the person using both the calculated first optimal pressure level for the comfort layer inflatable member and data measuring quality of sleep.

2. The method of claim 1, further comprising adjusting the comfort layer inflatable member to the calculated first optimal pressure level for the comfort layer inflatable member.

3. The method of claim 1, further comprising:

while the person is not positioned on the evaluating member, adjusting a pressure of a support layer inflatable member disposed within a support layer of the evaluating member to an initial support value;

while the person is positioned on the evaluating member in the first position, measuring a pressure of the support layer inflatable member as a first measured support value;

calculating a difference between the first measured support value and the initial support value as $\Delta_{SUPPORT\ PRESSURE\ 1}$;

calculating a first optimal pressure level for the support layer inflatable member using $\Delta_{SUPPORT\ PRESSURE\ 1}$; and recommending the sleep support member for the person using the calculated first optimal pressure level for the support layer inflatable member.

4. The method of claim 3, further comprising adjusting the support layer inflatable member to the calculated first optimal pressure level for the support layer inflatable member.

5. The method of claim 1, further comprising:

while the person is not positioned on the evaluating member, measuring a pressure at a first region of a foundation layer of the evaluating member as an initial foundation value;

while the person is positioned on the evaluating member in the first position, measuring a pressure at the first region of the foundation layer as a first measured foundation value;

calculating a difference between the first measured foundation value and the initial foundation value as $\Delta_{FOUNDATION\ PRESSURE\ 1}$;

calculating a first optimal pressure level for the first region of the foundation layer using $\Delta_{FOUNDATION\ PRESSURE\ 1}$; and recommending the sleep support member for the person using the calculated first optimal pressure level for the foundation layer.

6. The method of claim 3, wherein the support layer inflatable member is disposed below a layer of upper coils and is disposed above a layer of lower coils.

7. The method of claim 1, further comprising:

acquiring a digital size image of the person's body; and calculating the first optimal pressure level for the comfort layer inflatable member using the acquired digital size image.

8. The method of claim 3, wherein the support layer is disposed below the comfort layer.

9. The method of claim 1, wherein said first position comprises a preferred sleeping position of the person.

10. The method of claim 1, further comprising:

positioning the person on the evaluating member in a second position;

while the person is positioned on the evaluating member in the second position, measuring a pressure of the comfort layer inflatable member as a second measured comfort value;

calculating a difference between the second measured comfort value and the initial comfort value as $\Delta_{COMFORT\ PRESSURE\ 2}$;

calculating a second optimal pressure level for the comfort layer inflatable member using $\Delta_{COMFORT\ PRESSURE\ 2}$; and recommending the sleep support member for the person using the calculated second optimal pressure level for the comfort layer inflatable member.

11. The method of claim 3, further comprising:

positioning the person on the evaluating member in a second position;

while the person is positioned on the evaluating member in the second position, measuring a pressure of the comfort layer inflatable member as a second measured comfort value;

calculating a difference between the second measured comfort value and the initial comfort value as $\Delta_{COMFORT\ PRESSURE\ 2}$;

calculating a second optimal pressure level for the comfort layer inflatable member using $\Delta_{COMFORT\ PRESSURE\ 2}$; and recommending the sleep support member for the person using the calculated second optimal pressure level for the comfort layer inflatable member.

12. The method of claim 3, further comprising:

positioning the person on the evaluating member in a second position;

while the person is positioned on the evaluating member in the second position, measuring a pressure of the support layer inflatable member as a second measured support value;

calculating a difference between the second measured support value and the initial support value as $\Delta_{SUPPORT\ PRESSURE\ 2}$;

calculating a second optimal pressure level for the support layer inflatable member using $\Delta_{SUPPORT\ PRESSURE\ 2}$; and recommending the sleep support member for the person using the calculated second optimal pressure level for the support layer inflatable member.

13. The method of claim 11, further comprising:

while the person is positioned on the evaluating member in the second position, measuring a pressure of the support layer inflatable member as a second measured support value;

calculating a difference between the second measured support value and the initial support value as $\Delta_{SUPPORT\ PRESSURE\ 2}$;

calculating a second optimal pressure level for the support layer inflatable member using $\Delta_{SUPPORT\ PRESSURE\ 2}$; and recommending the sleep support member for the person using the calculated second optimal pressure level for the support layer inflatable member.

14. The method of claim 5, further comprising:

positioning the person on the evaluating member in a second position;

while the person is positioned on the evaluating member in the second position, measuring a pressure at the first region of the foundation layer as a second measured foundation value;

calculating a difference between the second measured foundation value and the initial foundation value as $\Delta_{FOUNDATION\ PRESSURE\ 2}$;

calculating a second optimal pressure level for the first region of the foundation layer using $\Delta_{FOUNDATION\ PRESSURE\ 2}$; and recommending the sleep support member for the person using the calculated second optimal pressure level for the foundation layer.

15. The method of claim 3, further comprising:

while the person is not positioned on the evaluating member, measuring a pressure at a first region of a foundation layer of the evaluating member as an initial foundation value;

while the person is positioned on the evaluating member in the first position, measuring a pressure at the first region of the foundation layer as a first measured foundation value;

calculating a difference between the first measured foundation value and the initial foundation value as $\Delta_{FOUNDATION\ PRESSURE\ 1}$;

calculating a first optimal pressure level for the first region of the foundation layer using $\Delta_{FOUNDATION\ PRESSURE\ 1}$; and recommending the sleep support member for the person using the calculated first optimal pressure level for the foundation layer.

16. The method of claim 13, further comprising:

while the person is not positioned on the evaluating member, measuring a pressure at a first region of a foundation layer of the evaluating member as an initial foundation value;

while the person is positioned on the evaluating member in the first position, measuring a pressure at the first region of the foundation layer as a first measured foundation value;

calculating a difference between the first measured foundation value and the initial foundation value as $\Delta_{FOUNDATION\ PRESSURE\ 1}$;

calculating a first optimal pressure level for the first region of the foundation layer using $\Delta_{FOUNDATION\ PRESSURE\ 1}$; and recommending the sleep support member for the person using the calculated first optimal pressure level for the foundation layer.

17. The method of claim 16, further comprising:

while the person is positioned on the evaluating member in the second position, measuring a pressure at the first region of the foundation layer as a second measured foundation value;

calculating a difference between the second measured foundation value and the initial foundation value as $\Delta_{FOUNDATION\ PRESSURE\ 2}$;

calculating a second optimal pressure level for the first region of the foundation layer using $\Delta_{FOUNDATION\ PRESSURE\ 2}$; and recommending the sleep support member for the person using the calculated second optimal pressure level for the foundation layer.

18. The method of claim 1, wherein the comfort layer inflatable member is disposed in a region of the evaluating member corresponding to at least one of the person's head, neck and upper back; and wherein the method further comprises recommending a head support member.

19. A method for evaluating a person for a sleep system, the method comprising:

while the person is not positioned on an evaluating member:

adjusting a pressure of a comfort layer inflatable member disposed within a comfort layer of the evaluating member to a initial comfort value; and adjusting a pressure of a support layer inflatable member disposed within a support layer of the evaluating member to an initial support value;

positioning the person on the evaluating member in a first position;

while the person is positioned on the evaluating member in the first position:

measuring a pressure of the comfort layer inflatable member as a first measured comfort value; and measuring a pressure of the support layer inflatable member as a first measured support value;

calculating a difference between the first measured comfort value and the initial comfort value as $\Delta_{COMFORT\ PRESSURE\ 1}$;

calculating a difference between the first measured support value and the initial support value as $\Delta_{SUPPORT\ PRESSURE\ 1}$;

calculating, using at least one processor, a first optimal pressure level for the comfort layer inflatable member using $\Delta_{COMFORT\ PRESSURE\ 1}$;

calculating, using the at least one processor, a first optimal pressure level for the support layer inflatable member using $\Delta_{SUPPORT\ PRESSURE\ 1}$; and recommending, using the at least one processor, a sleep support member for the person using both the calculated first optimal pressure level for the comfort layer inflatable member and the calculated first optimal pressure level for the support layer inflatable member.

* * * * *